US006707357B1

(12) United States Patent
Chuang

(10) Patent No.: US 6,707,357 B1
(45) Date of Patent: Mar. 16, 2004

(54) ELECTROMAGNETIC SWITCH

(75) Inventor: Hung-Chieh Chuang, Nan-Tou Hsien (TW)

(73) Assignee: Tendex Electric Co., Ltd., Taipei Hsien (TW)

( * ) Notice: Subject to any disclaimer, the term of this patent is extended or adjusted under 35 U.S.C. 154(b) by 0 days.

(21) Appl. No.: 10/231,950

(22) Filed: Aug. 30, 2002

(51) Int. Cl.[7] ..... H01H 67/02
(52) U.S. Cl. ..... 335/132; 335/202
(58) Field of Search ..... 335/313–133, 335/202, 167–176; 200/293–308

(56) References Cited

U.S. PATENT DOCUMENTS 2,446,299 A * 8/1948 Nelsen ..... 335/120
2,606,260 A * 8/1952 Frese ..... 335/120
4,009,457 A * 2/1977 Guery et al. ..... 335/132
4,616,202 A * 10/1986 Kakizoe ..... 335/133
5,886,601 A * 3/1999 Kitamura et al. ..... 335/129
6,034,584 A * 3/2000 Hilfiker ..... 335/132
6,040,750 A * 3/2000 Pfab ..... 335/158

* cited by examiner

*Primary Examiner*—Lincoln Donovan
(74) *Attorney, Agent, or Firm*—Christie, Parker & Hale, LLP

(57) ABSTRACT

An electromagnetic switch includes an electromagnetic module and a contact module that is to be plugged into the electromagnetic module. The contact module includes a fixed contact member and a movable contact member that is pivoted to the fixed contact member so as to be rotatable relative to the fixed contact member between a first angular position for establishing a first circuit, and a second angular position for establishing a second circuit.

6 Claims, 8 Drawing Sheets

ELECTROMAGNETIC SWITCH

BACKGROUND OF THE INVENTION

1. Field of the Invention

This invention relates to an electromagnetic switch, more particularly to an electromagnetic switch with an electromagnetic module and a contact module that is to be plugged into the electromagnetic module.

2. Description of the Related Art

FIGS. 1 and 2 illustrate a conventional electromagnetic switch that includes a housing 3, first and second electromagnetic members 5, 6 mounted in the housing 3, a fixed contact member mounted in the housing 3 above the first and second electromagnetic members 5, 6, and a movable contact member 8 mounted in the housing 3 above the fixed contact member. Each of the first and second electromagnetic members 5, 6 includes a coil 51, a yoke 41 disposed below the coil 51, and an armature 61 disposed above the coil 51. The armature 61 of each of the first and second electromagnetic members 5, 6 has a pair of pushing arms 71 extending upwardly therefrom toward and pivoted to the movable contact member 8 via pivot studs 83 which are formed on two opposite ends of the movable contact member 8. First and second urging members 84, 85 are mounted in the housing 3 for respectively urging the opposite ends of the movable contact member 8 in an upward direction. The movable contact member 8 includes first and second movable contacts 821, 822, and is rotatable between a first angular position, in which, the first movable contact 821 is turned downwardly to electrically contact a first fixed contact 311 of the fixed contact member, which results from downward movement of the armature 61 of the first electromagnetic member 5 against an urging action of the first urging member 84 via the yoke 41 of the first electromagnetic member. 5 upon actuation of the coil 51 of the first electromagnetic member 5, and a second angular position, in which, the second movable contact 822 is turned downwardly to electrically contact a second fixed contact 312 of the fixed contact member, which results from downward movement of the armature 61 of the second electromagnetic member 6 against an urging action of the second urging member 85 via the yoke 41 of the second electromagnetic member 6 upon actuation of the coil 51 of the second electromagnetic member 6.

The conventional electromagnetic switch is disadvantageous in that since all of the components thereof are mounted in the housing 3, the assembly operation is relatively inconvenient and time-consuming. As a consequence, the manufacturing cost of the conventional electromagnetic switch is significantly increased. Moreover, the repair and the mounting and dismounting of a plurality of conductive wires thereon are laborious, and the urging members 84, 85 tend to fail after a period of use.

SUMMARY OF THE INVENTION

Therefore, the object of the present invention is to provide an electromagnetic switch that dispenses with the use of the aforesaid urging members and that is capable of overcoming the aforesaid drawbacks of the prior art.

According to the present invention, there is provided an electromagnetic switch that comprises: an electromagnetic module including first and second electromagnetic members, each of which includes a coil, a yoke disposed above the coil, and an armature disposed below the coil and movable upwardly when actuated by the yoke upon application of an electric current to the coil, the electromagnetic module further including first and second pushing units connected to and projecting upwardly and respectively from the armatures of the first and second electromagnetic members, and co-movable with the armatures, respectively; and a contact module including a fixed contact member disposed above the first and second electromagnetic members and including conductive first and second fixed contacts, and a movable contact member disposed between the electromagnetic module and the fixed contact member and including a movable seat with two opposite sides, and conductive first and second movable contacts which are respectively disposed at the opposite sides of the movable seat and which are vertically and respectively aligned with the first and second fixed contacts. The movable seat is pivoted to the fixed contact member so as to permit the movable contact member to be rotatable relative to the fixed contact member among a first angular position, in which the first movable contact is in electrical contact with the first fixed contact, whereas the second movable contact is spaced apart from the second fixed contact when the coil of the first electromagnetic member is actuated, a second angular position, in which the second movable contact is in electrical contact with the second fixed contact, whereas the first movable contact is spaced apart from the first fixed contact when the coil of the second electromagnetic member is actuated, and a normal angular position, in which the first and second movable contacts are spaced apart from the first and second fixed contacts, respectively, when the coils of the first and second electromagnetic members are disabled. The first and second pushing units respectively extend toward the opposite sides of the movable seat in such a manner that the first pushing unit is moved upwardly upon actuation of the armature of the first electromagnetic member so as to move the movable contact member to the first angular position, and that the second pushing unit is moved upwardly upon actuation of the armature of the second electromagnetic member so as to move the movable contact member to the second angular position.

BRIEF DESCRIPTION OF THE DRAWINGS

In the drawings which illustrate an embodiment of the invention.

DETAILED DESCRIPTION OF THE PREFERRED EMBODIMENT

Figure 1:
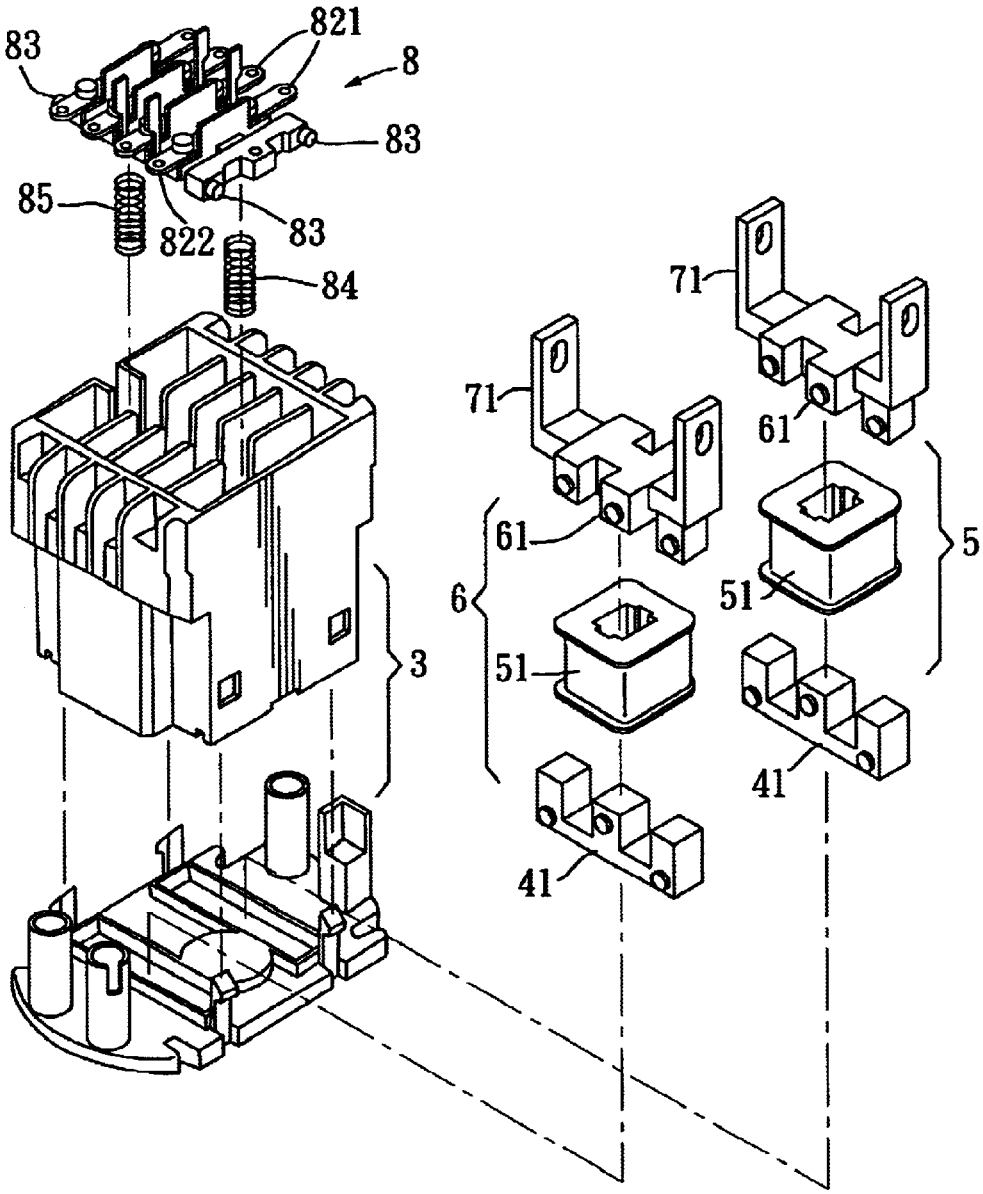
FIG. 1 PRIOR ART
FIG. 1 is an exploded perspective view of a conventional electromagnetic switch.
Figure 2:
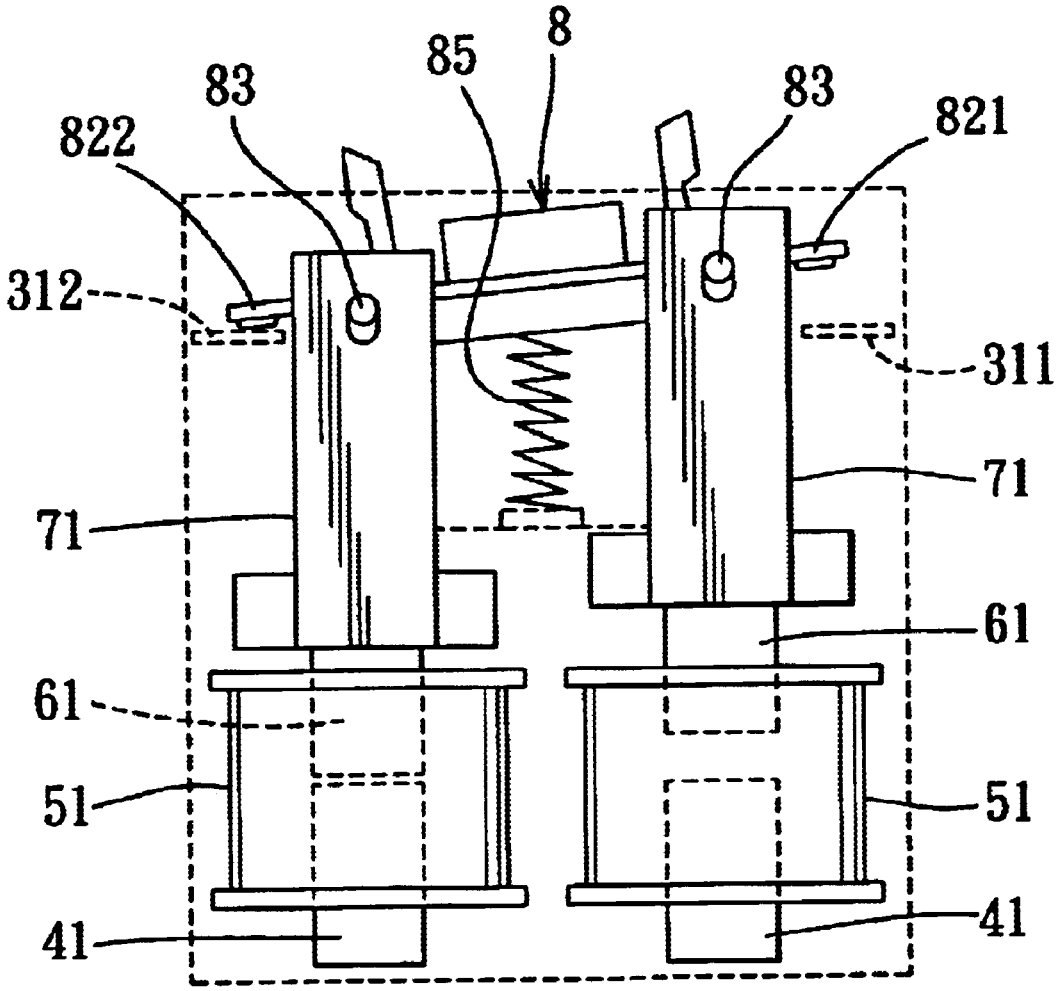
FIG. 2 PRIOR ART
FIG. 2 is a schematic view to illustrate how the electromagnetic switch of FIG. 1 works.

FIGS. 3 to 7 illustrate a preferred embodiment of an electromagnetic switch according to this invention. The electromagnetic switch includes an electromagnetic module 300 and a contact module 200 that is to be plugged into the electromagnetic module 300.

The electromagnetic module 300 includes first and second electromagnetic members 22, 23 (see FIG. 6), each of which includes a coil 222 (232), a yoke 221 (231) disposed above the coil 222 (232), and an armature 223 (233) disposed below the coil 222 (232) and movable upwardly when actuated by the yoke 221 (231) upon application of an electric current to the coil 222 (232). The electromagnetic module 300 further includes first and second pushing units 224, 234 connected to and projecting upwardly and respectively from the armatures 223, 233 of the first and second electromagnetic members 22, 23, and co-movable with the armatures 223, 233, respectively.

The contact module 200 includes a fixed contact member 12 disposed above the first and second electromagnetic members 22, 23 and including pairs of conductive first and second fixed contacts 120, 121 (only one pair of the first and second fixed contacts 120, 121 will be described in the following paragraphs), and a movable contact member 13 disposed between the electromagnetic module 300 and the fixed contact member 12 and including a movable seat 132 with two opposite sides, and pairs of conductive first and second movable contacts 130, 131 (only one pair of the first and second movable contacts 130, 131 will be described in the following paragraphs) which are respectively disposed at the opposite sides of the movable seat 132 and which are vertically and respectively aligned with the respective pair of the first and second fixed contacts 120, 121. The movable seat 132 is pivoted to the fixed contact member 12 so as to permit the movable contact member 13 to be rotatable relative to the fixed contact member 12 among a first angular position (see FIG. 8), in which the first movable contact 130 is in electrical contact with the first fixed contact 120, whereas the second movable contact 131 is spaced apart from the second fixed contact 121 when the coil 222 of the first electromagnetic member 22 is actuated, a second angular position (see FIG. 9), in which the second movable contact 131 is in electrical contact with the second fixed contact 121, whereas the first movable contact 130 is spaced apart from the first fixed contact 120 when the coil 232 of the second electromagnetic member 23 is actuated, and a normal angular position (see FIG. 7), in which the first and second movable contacts 130, 131 are spaced apart from the first and second fixed contacts 120, 121, respectively, when the coils 222, 232 of the first and second electromagnetic members 22, 23 are disabled.

The first and second pushing units 224, 234 respectively extend toward the opposite sides of the movable seat 132 in such a manner that the first pushing unit 224 is moved upwardly upon actuation of the armature 223 of the first electromagnetic member 22 so as to move the movable contact member 13 to the first angular position, and that the second pushing unit 234 is moved upwardly upon actuation of the armature 233 of the second electromagnetic member 23 so as to move the movable contact member 13 to the second angular position.

Figure 11:
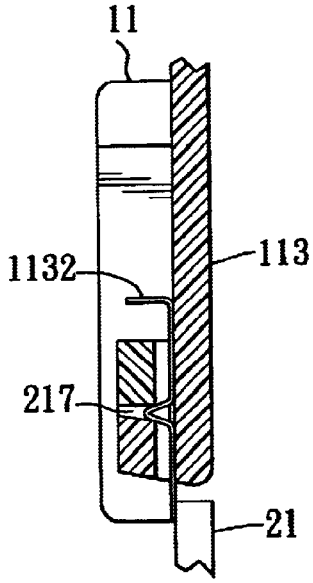
FIG. 11 is a fragmentary partly sectional view to illustrate how the contact module is secured to the electromagnetic module shown in FIG. 4.

The electromagnetic module 300 further includes a first housing half 21 formed with a pair of opposing latch-engaging bars 217. The contact module 200 further includes a second housing half 11 which is formed with a pair of opposing latches 113 and which is detachably coupled to the first housing half 21 via engagement between each of the latches 113 and a respective one of the latch-engaging bars 217. An abutting member 1132 is disposed between and abuts against each of the latches 113 and the respective one of the latch-engaging bars 217 so as to tightly secure the first housing half 21 to the second housing half 11 (see FIG. 11). The first and second electromagnetic members 22, 23 are mounted in the first housing half 21. The fixed contact member 12 and the movable contact member 13 are mounted in the second housing half 11.

Each of the first and second pushing units 224, 234 includes an armature casing 2241 (2341) with two opposite ends, and a pair of pushing arms 2243 (2343) extending upwardly and respectively from the opposite ends of the armature casing 2241 (2341) for moving the movable contact member 13 to a respective one of the first and second angular positions. The first housing half 21 has a top open end 210 defining a top opening 212. The electromagnetic module 300 further includes a guiding plate 215 mounted on the top open end 210 of the first housing half 21 and covering the top opening 212, and formed with a plurality of first through-holes 2152 for extension of the pushing arms 2243 (2343) of the first and second pushing units 224, 234 therethrough, respectively, so as to guide upward and downward movements of the first and second pushing units 224, 234. Each of the armatures 223, 233 is secured in the respective one of the armature casings 2241, 2341 via a latch plate 2245 extending through the armature 223 (233) and the respective armature casing 2241 (2341).

The coil 222 (232) of each of the first and second electromagnetic members 22, 23 includes a top flange 2220 (2320) formed with a pair of conductive clamping members 2221 (2321). The guiding plate 215 is further formed with a plurality of second through-holes 2153 for extension of the clamping members 2221, 2321 of the top flanges 2220, 2320 of the coils 222, 232 of the first and second electromagnetic members 22, 23 therethrough, respectively. The fixed contact member 12 further includes a plurality of conductive terminal legs 1211 which are releasably and respectively gripped by the clamping members 2221, 2321 so as to permit the contact module 200 to be plugged into the electromagnetic module 300 and so as to permit electrical connection between each of the coils 222, 232 of the first and second electromagnetic members 22, 23 and electrical wires (not shown) via a respective one of the terminal legs 1211.

The fixed contact member 12 further includes a stationary seat 122 with two opposite sides. The first and second fixed contacts 120, 121 are disposed at the opposite sides of the stationary seat 122 of the fixed contact member 12, respectively. A pair of pivotal lugs 123 extend downwardly from two opposite ends of the stationary seat 122 of the fixed contact member 12 between the first and second fixed contacts 120, 121, and are formed with elongated slots 124, respectively. The movable seat 132 of the movable contact member 13 further includes a pair of pivot studs 133 that respectively extend into and that are movable within the elongated slots 124 so as to permit pivotal action of the movable contact member 13 relative to the fixed contact member 12 between the first and second angular positions.

Figure 5:
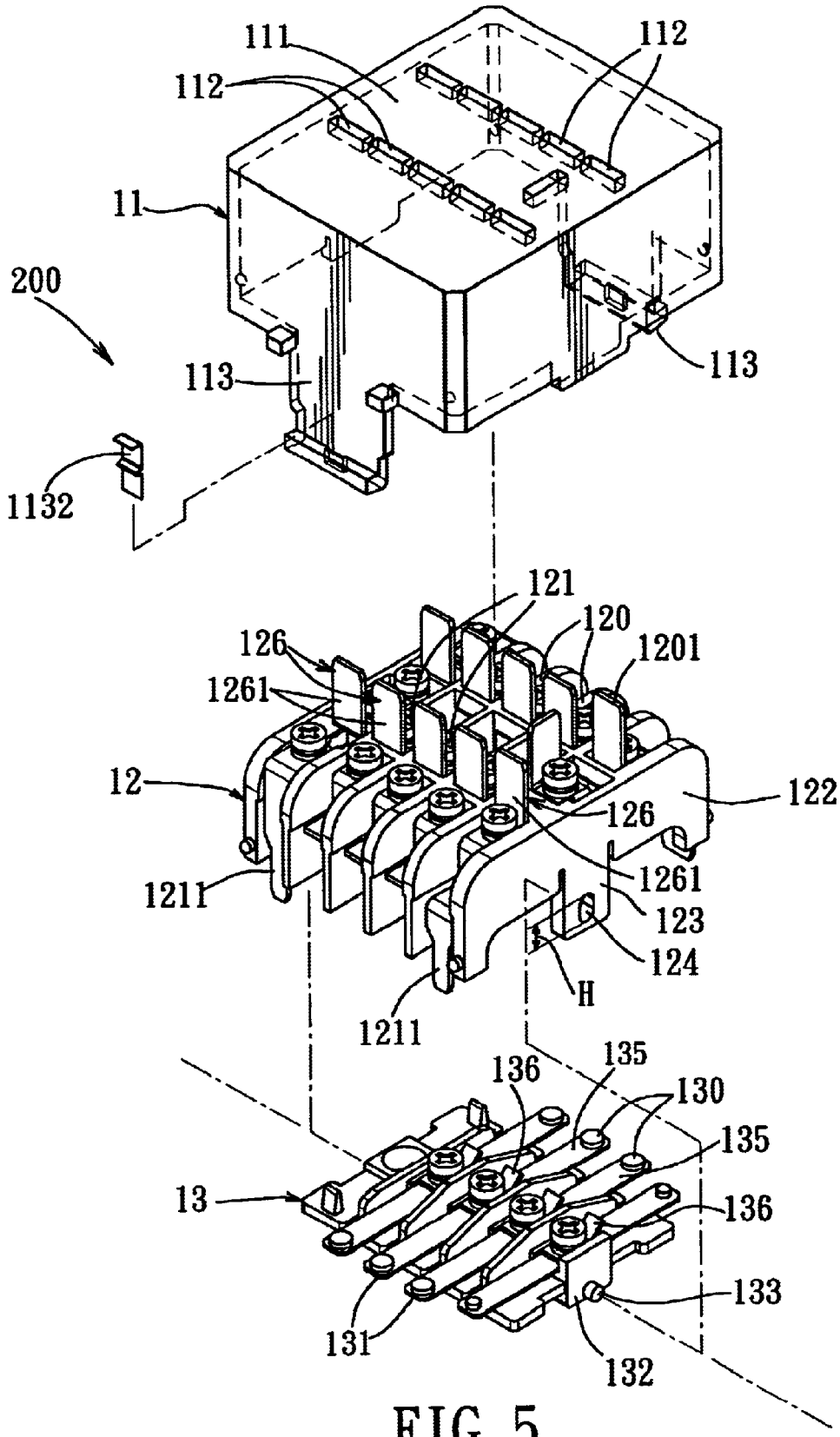
FIG. 5 is an exploded perspective view of the contact module shown in FIG. 4.
Figure 7:
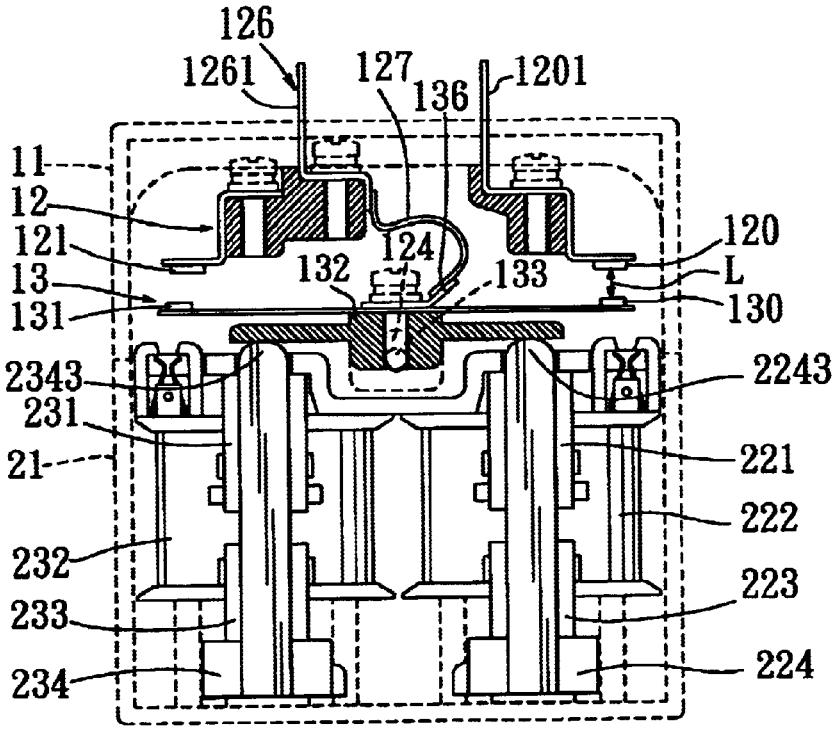
FIG. 7 is a partly sectional view to illustrate a movable contact member of the contact module shown in FIG. 4 when disposed at a normal angular position relative to a fixed contact member of the contact module.
Figure 10:
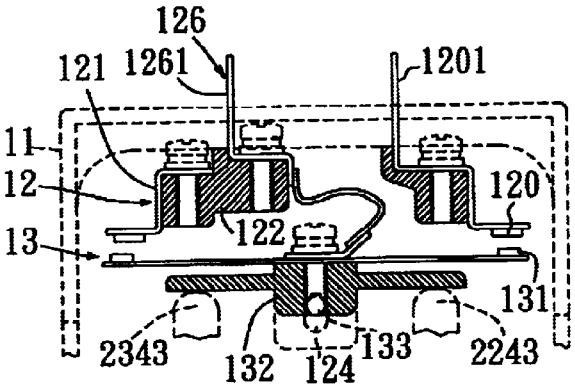
FIG. 10 is a fragmentary sectional view of the movable contact member of the contact module shown in FIG. 4, which is disposed at an upper position relative to the fixed contact member of the contact module.

Referring to FIG. 10, in combination with FIGS. 5 and 7, each of the first and second movable contacts 130, 131 of the movable contact member 13 is spaced apart from a respective one of the first and second fixed contacts 120, 121 by a vertical length (L) when the movable contact member 13 is disposed at the normal angular position. Each of the elongated slots 124 has a vertical height (H) that is less than the vertical length (L) so as to prevent simultaneous electrical contact between the first movable contact 130 and the first fixed contact 120 and between the second movable contact 131 and the second fixed contact 121 when the coils 222, 232 of the first and second electromagnetic members 22, 23 are simultaneously actuated. As shown in FIG. 10, the movable contact member 13 is moved upwardly to an upper position, in which, each of the pivot studs 133 abuts against a top end of a slot-confining wall of a respective one of the elongated slots 124, when the coils 222, 232 of the first and second electromagnetic members 22, 23 are simultaneously actuated.

Figure 3:
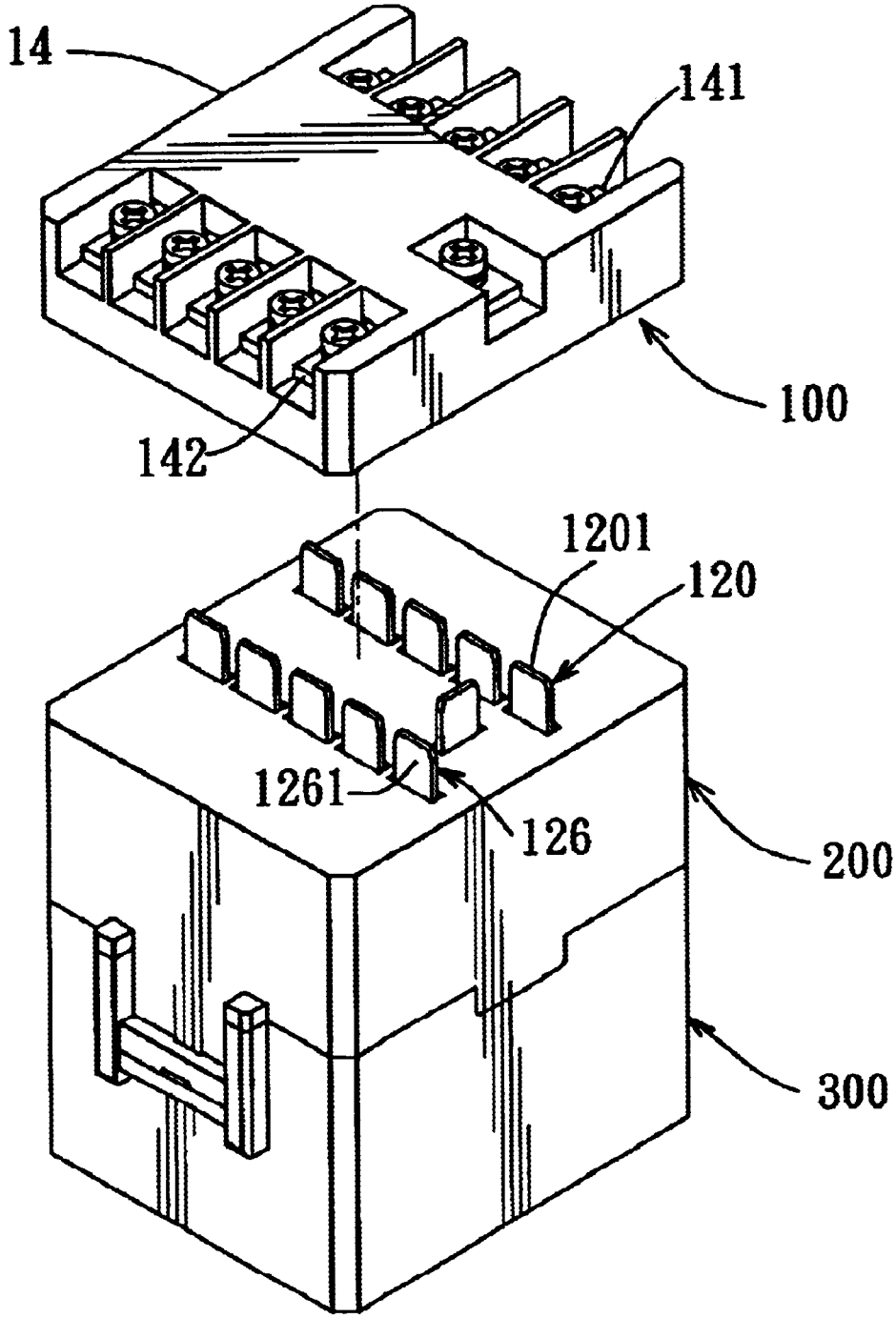
FIG. 3 is a partly exploded perspective view of a preferred embodiment of an electromagnetic switch according to this invention.
Figure 4:
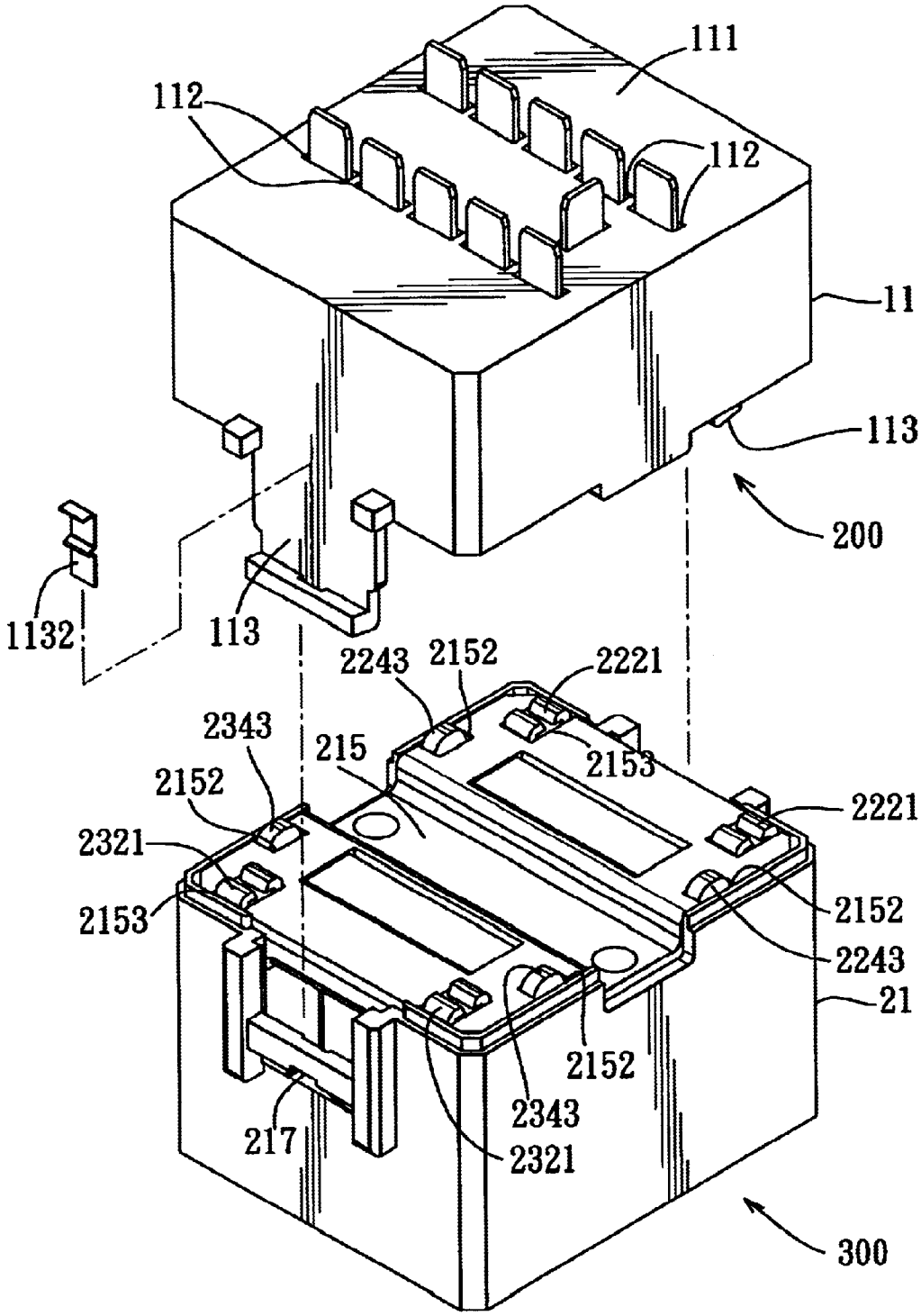
FIG. 4 is a partly exploded perspective view illustrating an electromagnetic module and a contact module of the electromagnetic switch of FIG. 3.
Figure 6:
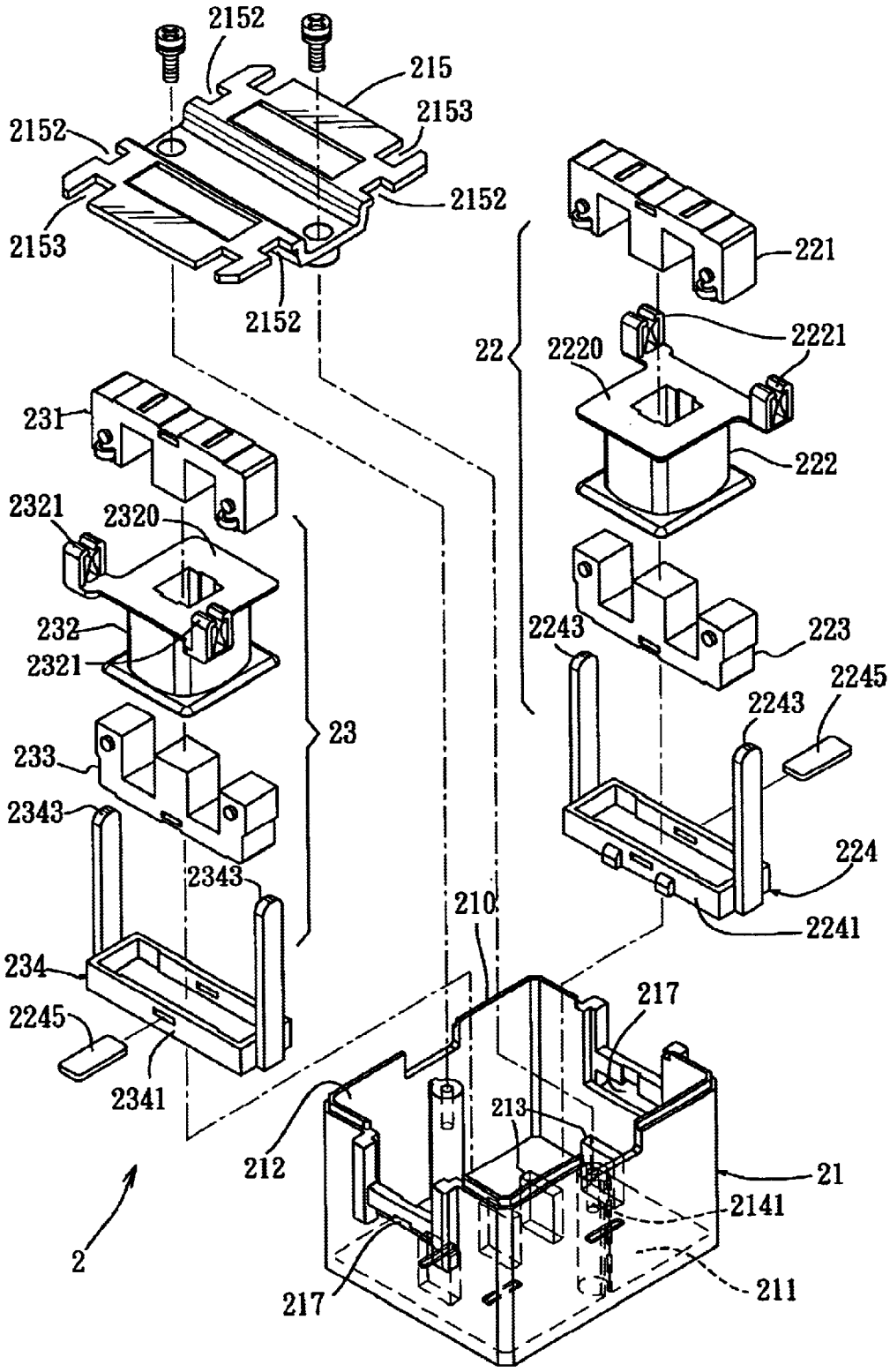
FIG. 6 is exploded perspective view of the electromagnetic module shown in FIG. 4.
Figure 8:
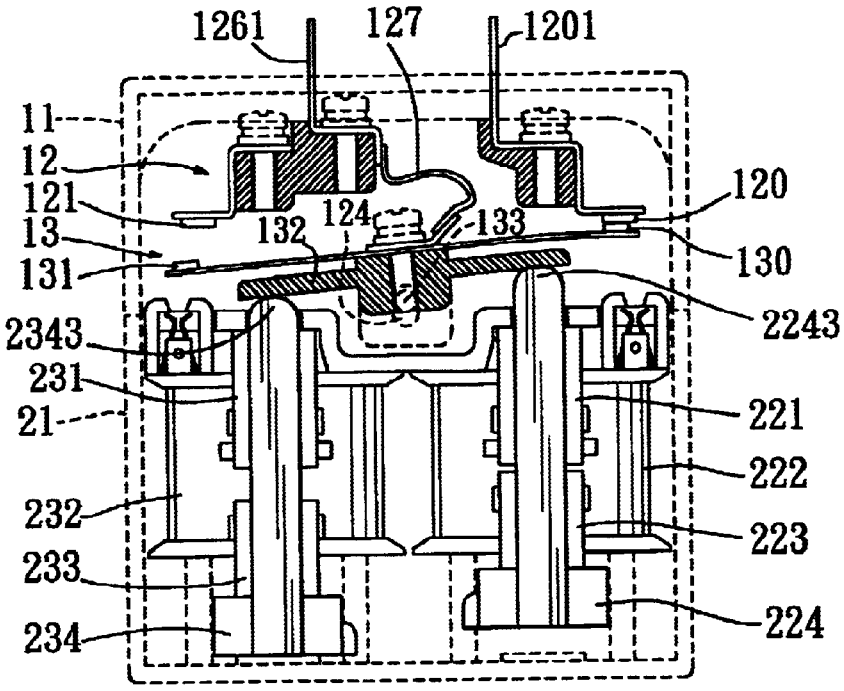
FIG. 8 is a partly sectional view of the movable contact member of the contact module shown in FIG. 4 when disposed at a first angular position relative to the fixed contact member of the contact module.
Figure 9:
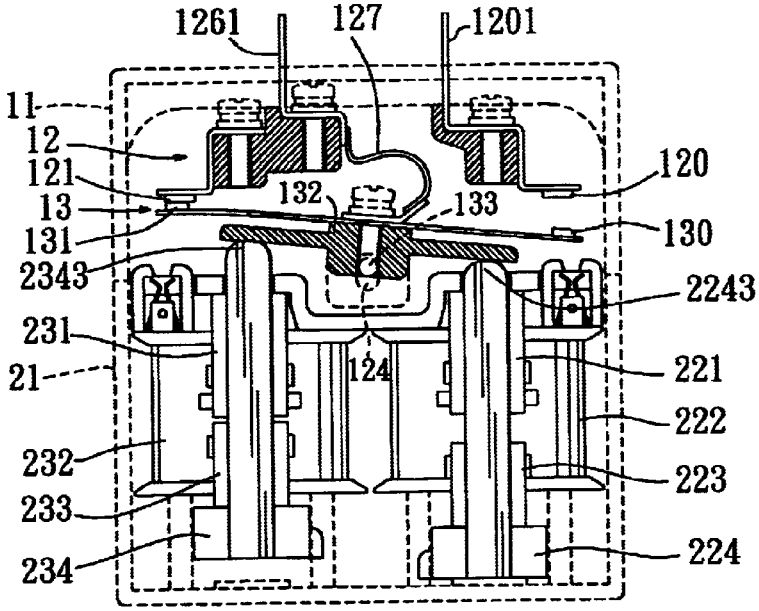
FIG. 9 is a partly sectional view of the movable contact member of the contact module shown in FIG. 4 when is disposed at a second angular position relative to the fixed contact member of the contact module.

Referring to FIGS. 3, 6 and 8, the second housing half 11 has a top wall 111 formed with a plurality of first and second openings 112. The movable contact member 13 further includes a plurality of conductive bridges 135 (only one of the bridges 135 will be described in the following paragraphs), each of which is mounted on the movable seat 132 and interconnects two of the first and second movable contacts 130, 131, and a plurality of conductive third movable contacts 136 (only one of the third contacts 136 will be described in the following paragraphs), each of which is electrically connected to the respective bridge 135 at a position between the first and second movable contacts 130, 131 in such a manner that the first and third movable contacts 130, 136 form a first circuit when the movable contact member 13 is disposed at the first angular position, and that the second and third movable contacts 131, 136 form a second circuit when the movable contact member 13 is disposed at the second angular position. The fixed contact member 12 further includes a plurality of conductive third fixed contacts 126 (only one of the third fixed contacts 126 will be described in the following paragraphs), each of which is in constant electrical contact with the respective third movable contact 136 via a conductive spring piece 127 so that the first circuit passes through the first fixed contact 120, the first movable contact 130, the third movable contact 136, and the third fixed contact 126, and that the second circuit passes through the second fixed contact 121, the second movable contact 131, the third movable contact 136, and the third fixed contact 126. Each of the first and third fixed contacts 120, 126 has a blade portion 1201 (1261) projecting upwardly and outwardly of the second housing half 11 from the stationary seat 122 through a respective one of the first and second openings 112.

Since the contact module 200 can be plugged into the electromagnetic module 300, the aforesaid drawbacks as encountered in the prior art can be eliminated. Moreover, the electromagnetic switch of this invention dispenses with the use of the aforesaid urging members employed in the conventional electromagnetic switch.

With the invention thus explained, it is apparent that various modifications and variations can be made without departing from the spirit of the present invention. It is therefore intended that the invention be limited only as recited in the appended claims.

I claim:

1. An electromagnetic switch comprising:

an electromagnetic module including first and second electromagnetic members, each of which includes a coil, a yoke disposed above said coil, and an armature disposed below said coil and movable upwardly when actuated by said yoke upon application of an electric current to said coil, said electromagnetic module further including first and second pushing units connected to and projecting upwardly and respectively from said armatures of said first and second electromagnetic members, and co-movable with said armatures, respectively; and a contact module including a fixed contact member disposed above said first and second electromagnetic members and including conductive first and second fixed contacts, and a movable contact member disposed between said electromagnetic module and said fixed contact member and including a movable seat with two opposite sides, and conductive first and second movable contacts which are respectively disposed at said opposite sides of said movable seat and which are vertically and respectively aligned with said first and second fixed contacts, said movable seat being pivoted to said fixed contact member so as to permit said movable contact member to be rotatable relative to said fixed contact member among a first angular position, in which said first movable contact is in electrical contact with said first fixed contact, whereas said second movable contact is spaced apart from said second fixed contact when said coil of said first electromagnetic member is actuated, a second angular position, in which said second movable contact is in electrical contact with said second fixed contact, whereas said first movable contact is spaced apart from said first fixed contact when said coil of said second electromagnetic member is actuated, and a normal angular position, in which said first and second movable contacts are spaced apart from said first and second fixed contacts, respectively, when said coils of said first and second electromagnetic members are disabled;

wherein said first and second pushing units respectively extend toward said opposite sides of said movable seat in such a manner that said first pushing unit is moved upwardly upon actuation of said armature of said first electromagnetic member so as to move said movable contact member to said first angular position, and that said second pushing unit is moved upwardly upon actuation of said armature of said second electromagnetic member so as to move said movable contact member to said second angular position.

2. The electromagnetic switch of claim 1, wherein said electromagnetic module further includes a first housing half, said contact module further including a second housing half which is detachably coupled to said first housing half, said first and second electromagnetic members being mounted in said first housing half, said fixed contact member and said movable contact member being mounted in said second housing half.

3. The electromagnetic switch of claim 2, wherein each of said first and second pushing units includes an armature casing with two opposite ends, and a pair of opposing pushing arms extending upwardly and respectively from said opposite ends of said armature casing for moving said movable contact member to a respective one of said first and second angular positions, said first housing half having a top open end defining a top opening, said electromagnetic module further including a guiding plate mounted on said top open end of said first housing half and covering said top opening, and formed with a plurality of first through-holes for extension of said pushing arms of said first and second pushing units therethrough, respectively, so as to guide upward and downward movements of said first and second pushing units.

4. The electromagnetic switch of claim 3, wherein said coil of each of said first and second electromagnetic members includes a top flange formed with a pair of conductive clamping members, said guiding plate being further formed with a plurality of second through-holes for extension of said clamping members of said top flanges of said coils of said first and second electromagnetic members therethrough, respectively, said fixed contact member further including a plurality of conductive terminal legs which are releasably and respectively gripped by said clamping members so as to permit said contact module to be plugged into said electromagnetic module.

5. The electromagnetic switch of claim 1, wherein said fixed contact member further includes a stationary seat with two opposite sides, said first and second fixed contacts being disposed at said opposite sides of said stationary seat of said fixed contact member, respectively, said fixed contact member further including a pair of pivotal lugs that extend downwardly from said stationary seat of said fixed contact member between said first and second fixed contacts and that are formed with elongated slots, respectively, said movable seat of said movable contact member further including a pair of pivot studs that respectively extend into and that are movable within said elongated slots so as to permit pivotal action of said movable contact member relative to said fixed contact member between said first and second angular positions.

6. The electromagnetic switch of claim 5, wherein each of said first and second movable contacts of said movable contact member is spaced apart from a respective one of said first and second fixed contacts by a vertical length when said movable contact member is disposed at said normal angular position, each of said elongated slots having a vertical height that is less than said vertical length so as to prevent simultaneous electrical contact between said first movable contact and said first fixed contact and between said second movable contact and said second fixed contact when said coils of said first and second electromagnetic members are simultaneously actuated.

* * * * *